United States Patent [19]

Yake

[11] 4,046,261

[45] Sept. 6, 1977

[54] DISHWASHER RACK

[75] Inventor: William H. Yake, Connersville, Ind.

[73] Assignee: Design & Manufacturing Corporation, Connersville, Ind.

[21] Appl. No.: 655,454

[22] Filed: Feb. 5, 1976

[51] Int. Cl.[2] ..... A47G 19/08

[52] U.S. Cl. ..... 211/41; 211/126; 211/184; 220/19; 220/22.3

[58] Field of Search ..... 211/41, 40, 181, 184, 211/126; 312/311, 312; 220/19, 22.3, 22.2, 22.1

[56] References Cited

U.S. PATENT DOCUMENTS

| | | | |
|---|---|---|---|
| 1,562,614 | 11/1925 | Blakeslee | 211/41 |
| 2,804,213 | 8/1957 | Fox et al. | 211/41 |
| 2,971,668 | 2/1961 | Peglow | 211/41 D X |
| 3,167,183 | 1/1965 | Claywell et al. | 211/181 X |
| 3,451,556 | 6/1969 | Macoicz | 211/181 X |

*Primary Examiner*—Roy D. Frazier
*Assistant Examiner*—Robert W. Gibson, Jr.
*Attorney, Agent, or Firm*—Melville, Strasser, Foster & Hoffman

[57] ABSTRACT

A rack structure for an automatic dishwasher. The rack structure comprises a plurality of wire members welded together to form a rectangular, openwork rack having a bottom, upstanding front and rear walls and upwardly and outwardly sloping side walls. At least one pair of removable fences is provided, each fence comprising a plurality of upstanding wire members with a horizontal wire member welded thereto and spaced upwardly from the bottom ends thereof. Means are provided to removably mount the fences within the rack structure in parallel spaced relationship to each other and to the rack structure side walls. The fence mounting means may be so configured as to provide more than one predetermined position in which each fence may be mounted so as to render adjustable the distance between adjacent fences and the distance between each rack structure side wall and the adjacent one of the fences. Means may also be provided to lock each fence in its selected predetermined position in the fence mounting means. The wire members of the entire rack structure, including the removable fences, are coated with a protective plastic to prevent rust and corrosion thereof.

17 Claims, 14 Drawing Figures

DISHWASHER RACK

BACKGROUND OF THE INVENTION

1. Field of the Invention

The invention relates to a dishwasher rack, and more particularly to such a rack provided with upstanding front, rear and side walls and a bottom. Novel removable fences are mounted within the rack, extending from front to rear thereof in parallel spaced relationship.

2. Description of the Prior Art

The rack structure of the present invention may serve as either the upper or lower rack of a top loading or front loading dishwasher. For purposes of an exemplary showing, the rack is illustrated in its form as the upper rack of a front loading dishwasher.

Heretofore, the upper rack of a front loading dishwasher has comprised a plurality of wires welded together to form a generally rectangular, openwork rack. It has been common in the art to coat the wires with a protective plastic to prevent rust and corrosion. In general, such racks have been characterized by front, rear and side walls together with a bottom. In its most usual form, the bottom of the typical prior art rack has an upwardly extending central portion and downwardly and outwardly sloping side portions so that the rack is characterized by a relatively shallow central portion from front to rear and trough-like portions along its longitudinal sides. Part of the reason for this lay in the fact that the bottom served as a primary support element for the tableware within the rack.

From the beginning, it was realized that additional support for the tableware in the form of members extending upwardly from the rack bottom was required to maintain the tableware properly oriented during the washing and rinsing cycles. Initially, fixed upstanding members were provided, substantially throughout the rack. This was not altogether satisfactory, however, because it required the arrangement of tableware in a substantially fixed and predetermined manner and limited the type, size and number of tableware items which could be accommodated within the rack.

In order to overcome this problem, prior art workers devised a number of different expedients. One solution was to provide a plurality of individual upstanding members which could be inserted and removed from the rack and which could be located in various arrangements. U.S. Pat. No. 3,451,556 and 3,451,557 are exemplary of such arrangements. While offering versatility to the rack structure, the problem has been that these racks are made up of a large number of individual parts which must be stored by the housewife when not in use and which must be individually arranged, depending upon the size, number and nature of the tableware elements to be washed.

Another solution to the problem entailed the use of shiftable fence-like structures running from front to rear of the rack. These fence structures were generally pivotally mounted and were capable of assuming various positions ranging from a collapsed position to an upright position. U.S. Pat. Nos. 3,126,098 and 3,269,548 are exemplary of such hinged fences.

The hinging of the fences and the provision of various types of latch means rendered such rack structures difficult and expensive to manufacture. Furthermore, when in their collapsed position, the fences tended to obstruct the bottom of the rack and to interfere with the proper flow of wash and rinse water through the rack.

The present invention provides a dishwasher rack with a more nearly flat bottom which is simpler and less expensive to manufacture and provides a deeper rack of better appearance and greater versatility. Furthermore, the more nearly flat bottom of the rack structure provides more room for a spray device located between the upper and lower racks.

The rack of the present invention has at least two removable fences running longitudinally of the rack (i.e. from the front to the rear of the rack). When in position, the removable fences offer support for various types of tableware. When it is desired to place oversize or unusually shaped tableware in the rack, one or more of these fences may be removed so that a portion of or the entire interior of the rack is unobstructed. The removed fences can be stored in various positions within the rack, or removed completely from the rack and in either instance, proper flow of wash and rinse water through the rack is assured.

The bottom of the rack of the present invention is so configured so as to cooperate with the rack side walls and at least some of the removable fences to provide novel drinking glass support by which the inverted glasses are tilted to assure proper drainage of their bottoms. Furthermore, the fences cooperate to maintain dishes up off the bottom of the rack so that their lowermost edges will not protrude below the rack, as is common with many prior art structures.

SUMMARY OF THE INVENTION

The rack of the present invention comprises a plurality of longitudinally extending wire members in parallel spaced relationship and transversely extending wire members in parallel spaced relationship. These longitudinal and transverse wire members are welded together to form an essentially flat bottom for the rack. The ends of the longitudinally extending and transversely extending wire members are bent upwardly to form the front and rear walls and the upwardly and outwardly sloping side walls of the rack. A series of wire members surround these upturned ends to complete the front, rear and side walls.

The rack of the present invention is also provided with at least two (and preferably four) removable fences. Each removable fence comprises a plurality of upstanding wire members with a horizontal wire member welded thereto at a position spaced upwardly from the bottom ends thereof. Mounting means for the removable fences are affixed to the bottom of the rack structure near the front and rear walls thereof. Each mounting means is provided with at least one slot for each fence. Each slot is adapted to receive the bottom portion of the end most upstanding wire member of its respective fence. The fence mounting means may be provided with a plurality of slots for each fence so that the distance between adjacent fences and the distance between the rack structure side walls and their respective adjacent fences may be varied. Means are present to maintain each fence in its selected mounting means slots.

The rack structure bottom is so configured as to cooperate with the rack side walls and at least some of the fences to provide novel drinking glass support and the fences themselves provide novel tableware support, all as will be described hereinafter.

The rack may also be provided with wheel or glide mounting means so that it may be conventionally supported within the vat and shifted into and out of the vat for loading and unloading.

Finally, the entire rack structure, including the removable fences, may be conventionally coated with a plastic material to prevent rust or corrosion.

DESCRIPTION OF THE PREFERRED EMBODIMENTS

Figure 1:
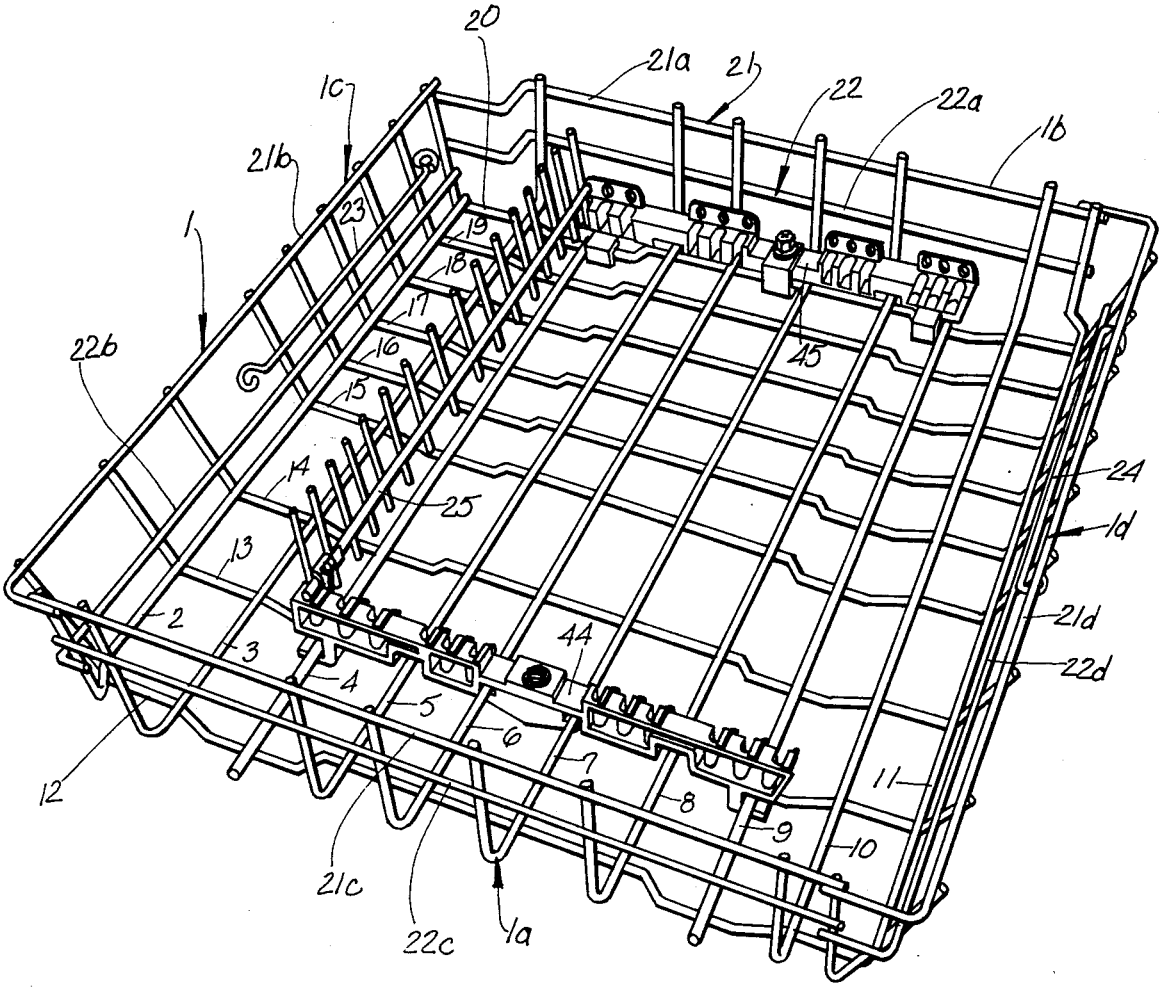
FIG. 1 is a perspective view of the rack of the present invention with one of the removable fences mounted therein.

Reference is made to FIGS. 1 through 4 wherein like parts have been given like index numerals.

The rack of the present invention is generally indicated by index numeral 1 and is made up of a plurality of longitudinally extending wire members 2 through 11. The forward ends of these wire members (with the exception of wire members 4 and 9) are turned upwardly to form the front wall of the rack (generally indicated at 1*a*) while the rear ends of these wire members (with the exception of wire members 2, 4 and 9) are turned upwardly to form the rear wall of the rack (generally indicated at 1*b*). The portion of each of these wire members between its upturned ends constitutes a part of the bottom of the rack.

A plurality of transverse wire members 12 through 20 extend beneath the wire members 2 through 11 and are welded at each intersection thereof. The wire members 12 through 20 complete the bottom of the rack. The left hand end of each of these transverse wire members is bent upwardly and outwardly to define the left longitudinal wall of the rack generally indicated at 1*c*. Similarly, the right hand end of each of these transverse wire members is bent upwardly and outwardly to define the right hand wall of the rack structure generally indicated at 1*d*.

A first series of wire elements, generally indicated at 21, passes about the upper periphery of the rack and is welded to the uppermost ends of the upturned portions of the longitudinal wire members 2, 3, 5 through 8, 10 and 11 and the transverse wire members 12 through 20. This series of peripheral wire elements 21 defines the upper edge of the rack and is made up of four parts, 21*a* through 21*d*. The part 21*a* is welded to the exterior of the upper ends of those portions of the longitudinal wire members forming the rear wall 1*b*. Part 21*b* is welded to the interior surface of the uppermost portion of the transverse wires 12 through 20 defining the left wall 1*c* is welded to the exterior uppermost portion of those upturned portions of the longitudinal wire members defining the front wall 1*a*. Finally, the part 21*d* is welded to the interior of the uppermost ends of those portions of the transverse wire members 12 through 20 defining the right hand wall 1*d* of the rack. It will be understood by one skilled in the art that the parts 21*a* through 21*d*, defining the peripheral upper edge wire element series 21 strengthen the side, front and rear walls of the rack and maintain those wire elements constituting these walls in their proper positions.

A second series of peripheral wire elements is welded to the upturned ends of the longitudinal wire members 2, 3, 5 through 8, 10 and 11 and transverse wire members 12 through 20 parallel to the peripheral wire element series 21 and spaced therebelow to further strengthen the walls of the rack. This peripheral wire element series is generally indicated at 22 and again is made up of foour parts 22*a* through 22*d*.

Figure 2:
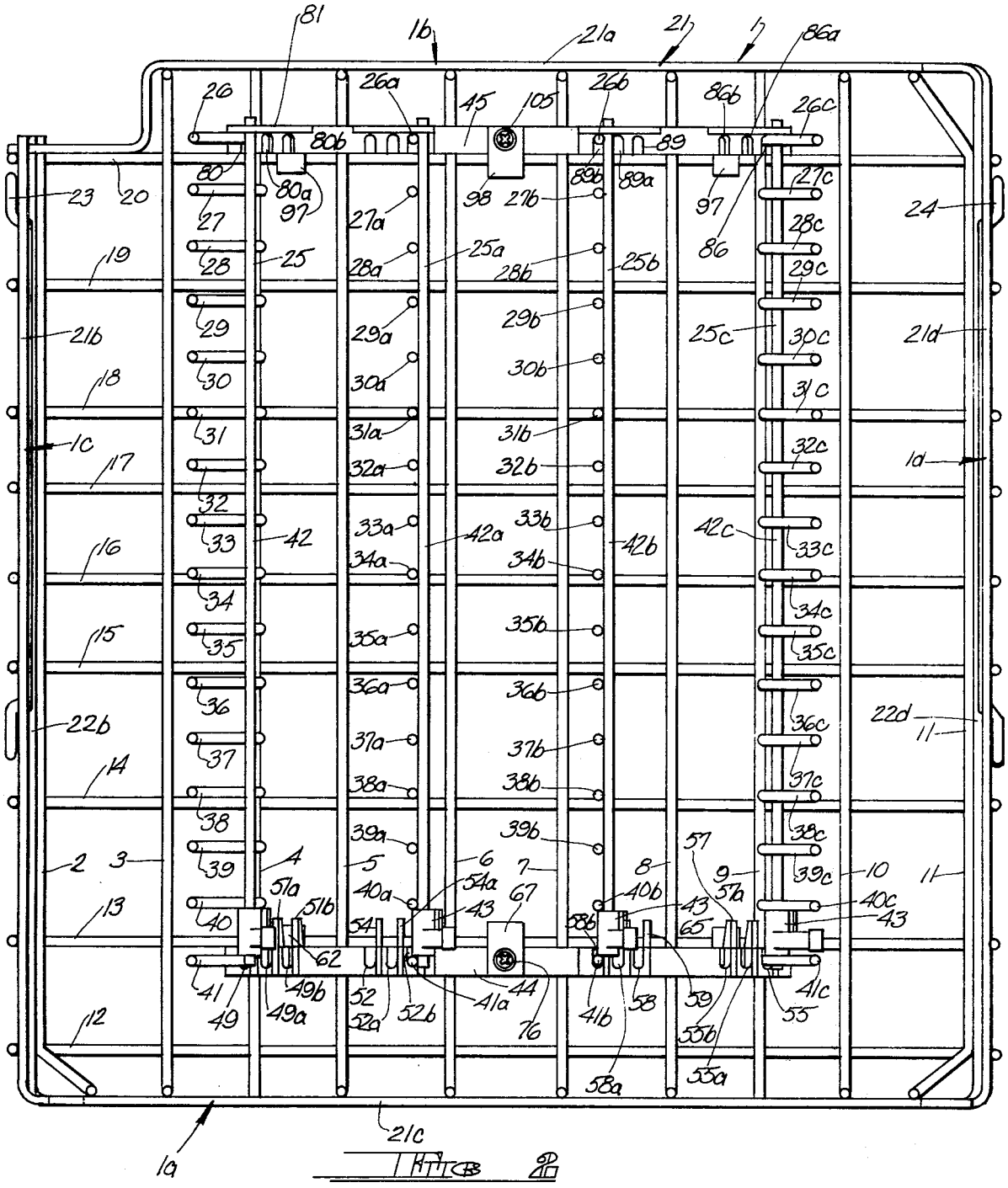
FIG. 2 is a plan view of the rack of FIG. 1 illustrating the removable fences in place.
Figure 4:
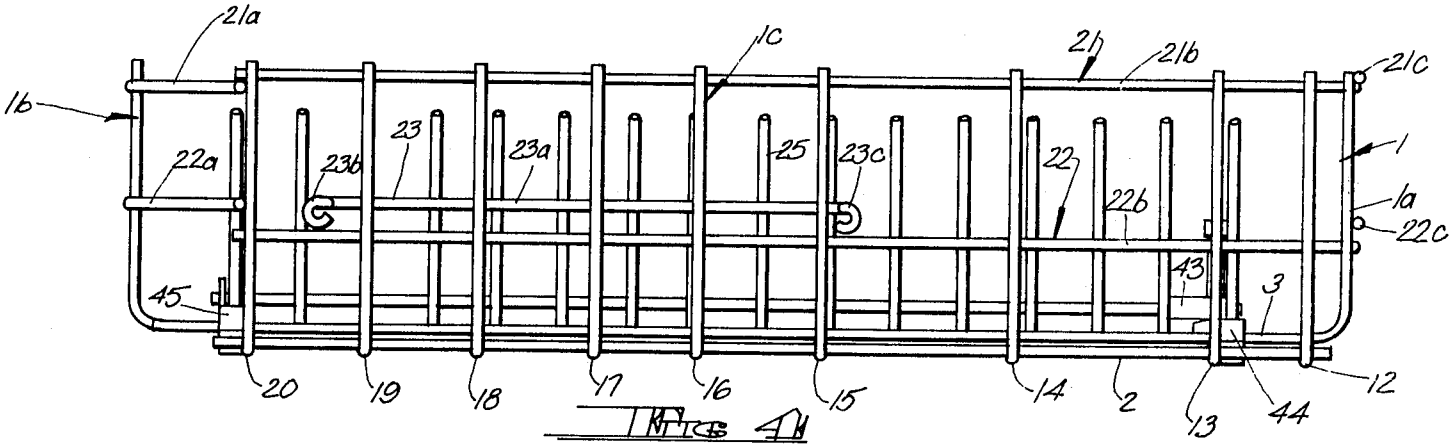
FIG. 4 is a side elevational view of the rack of FIG. 2, as seen from the left in that FIGURE.

To complete the basic structures, the rack of the present invention may be provided with any suitable type of glide or wheel mounts, depending on the manner in which the rack is supported in the dishwasher vat. For purposes of an exemplary showing wheel mounts 23 and 24 are illustrated in FIGS. 1 and 2 affixed to the upturned ends of transverse wires 15 through 19 at the left hand wall 1*c* and the right hand wall 1*d* of the rack 1, respectively. Wheel mounts 23 is most clearly shown in FIG. 4. Wheel mount 23 comprises a wire member having a longitudinally extending portion 23*a* welded to the upturned ends of transverse wires 15 through 19. The wheel mount terminates at either end in loop elements 23*b* and 23*c*, each adapted to receive the axial element of a wheel or roller (not shown). It will be understood that wheel mount 24 is substantially identical to wheel mount 23.

Figure 5:
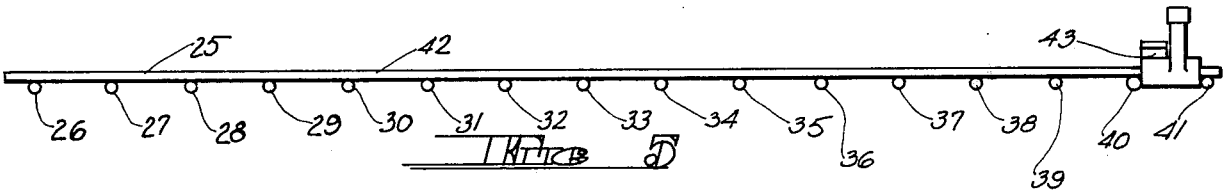
FIG. 5 is a plan view of one of the removable fences.

In FIG. 1 a removable fence is illustrated at 25. The fence 25 is most clearly shown in FIGS. 5 and 6. The fence comprises a plurality of upstanding wire elements 26 through 41 in parallel spaced relationship and welded near their bottom ends to a horizontally extending wire member 42. Fence 25 has mounted thereon a latch element 43 which will be described hereinafter.

Figure 3:
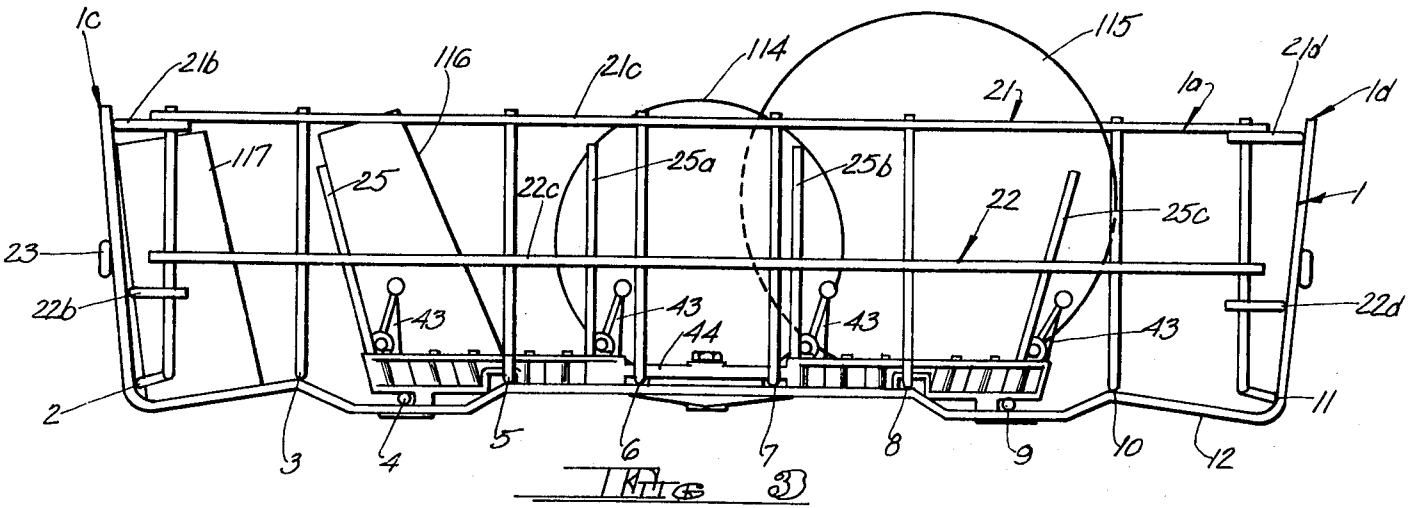
FIG. 3 is a front elevational view of the rack of FIG. 2.

The rack 1 will be provided with at least two fences. The total number of fences does not constitute a limitation on the present invention. In the preferred embodiment four fences are provided as is shown in FIGS. 2 and 3. Fences 25*a*, 25*b* and 25*c* are all identical to fence 25 and like parts have been given like index numerals followed by *a, b,* and *c,* respectively.

Figure 11:
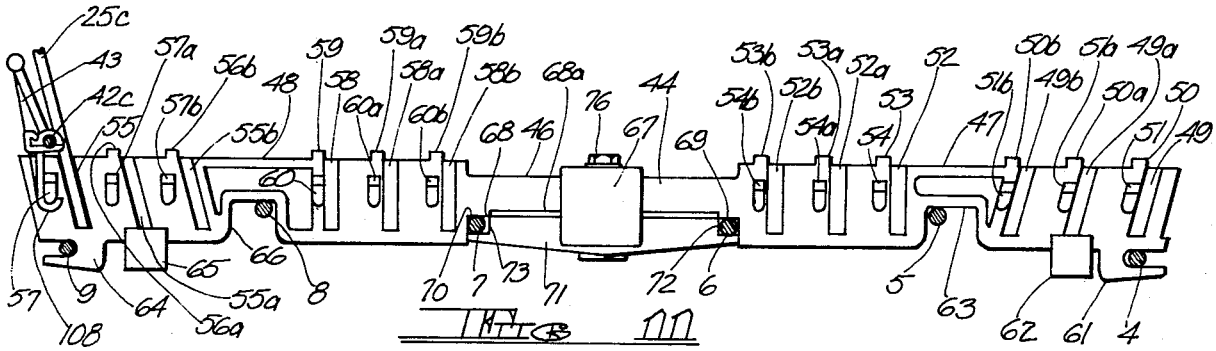
FIG. 11 is an elevational view of the slotted side of the front fence mounting means of the present invention.

In accordance with the present invention means are provided for mounting fences 25 through 25*c* at predetermined desired positions within rack 1, in parallel spaced relationship and extending from front to rear of the rack. To this end, the rack 1 is provided with a forward fence mounting bracket 44 and a rearward fence mounting bracket 45. Forward fence mounting bracket 44 is most clearly shown in FIGS. 2, 11 and 12. In FIG. 11 that side of the forward fence mounting bracket 44 is illustrated which faces the rearward fence mounting bracket 45 (see FIG. 2). Forward bracket 44 comprises an elongated member having a thin, bendable central portion 46 and enlarged end portions 47 and 48. End portion 47 contains three notches or slots 49 through 49*b,* any one of which is adapted to receive the endmost vertical member 41 of fence 25. Thus, slots 49 through 49*b* offer three predetermined positions for fence 25. The upper edge of end portion 47 of the forward bracket has a lug 50 upon which the end of horizontal member 42 of fence 25 will rest when vertical member 41 of that fence is located in slot 49. Similar lugs 50*a* and 50*b* are located adjacent slots 49*a* and 49*b,* respectively. Adjacent each of slots 49 through 49*b* there is a forwardly extending, integral latch lug. These lugs are shown at 51, 51*a* and 51*b.* The purpose of these latch lugs will be described hereinafter. Finally, it will be noted that slots 49 through 49*b* slope upwardly and outwardly. As a result, fence 25, when supported in any one of slots 49 through 49*b* will be tilted toward the lefthand wall 1*c* of rack 1, as is shown in FIG. 2. More will be said of this hereinafter.

End portion 47 has a second series of slots, 52, 52*a* and 52*b.* In association with these slots there are lugs 53, 53*a* and 53*b* similar to lugs 50 through 51*b* and latch lugs 54 through 54*b* similar to latch lugs 51 through 51*b.* Slots 52 through 52*b* offer three alternative positions for fence 25*a* (see FIG. 2) and are intended to receive the forwardmost vertical member 41*a* of fence 25*a.* Slots 52 through 52*b* are vertically oriented so that fence 25*a* will be held in a vertical, upright position.

End portion 48 of forward mounting bracket 44 has a series of upwardly and outwardly sloping slots 55 through 55*b* (equivalent to slots 49 through 59*b*) with associated upper lugs 56 through 56*b* (equivalent to lugs 50 through 50*b*) and latching lugs 57 through 57*b* (equivalent to latching lugs 51 through 51*b*). Similarly, a series of vertically oriented slots 58 through 58*b* (equivalent to slots 53 through 53*b*) are provided with associated lugs 59 through 59*b* and latching lugs 60 through 60*b.*

End portion 47 of the forward fence mounting bracket 44 has an outwardly opening hook-shaped element 61 adapted to engage the longitudinal wire member 4 of rack 1. A forwardly facing, downwardly depending hook-like element is shown at 62, intended to engage transverse wire member 13 of the rack. Finally, a notch 63 is provided in the bottom edge of end portion 47 to accommodate longitudinal rack wire member 5. In similar fashion, end portion 48 is provided with an outwardly opening hook-like element 64, similar to hook element 61, and intended to engage the longitudinal rack wire element 9. A forward facing, downwardly depending hook member, equivalent to hook member 62, is shown at 65, again intended to engage transverse rack wire member 13. Finally, end portion 48 has a notch 66, equivalent to the notch 63 of end portion 47, and intended to accommodate the longitudinal rack wire member 8.

The central portion 46 of the forward fence mounting bracket 44 has an integral downwardly depending hook-like element 67 which, like hook elements 62 and 65, is intended to engage transverse rack wire element 13. In its bottom edge, central portion 46 has an elongated notch 68 with a central portion 68*a* of greater depth. In this way, shoulders 69 and 70 are formed, adapted to receive longitudinal rack wires 6 and 7, respectively.

A clamping element is shown at 71. The overall length of clamping element 71 is substantially equal to the overall length of notch 68 so that the clamping element can be received therein. Clamping element 71 is provided at its ends with notches 72 and 73 to receive the longitudinal rack wire elements 6 and 7, respectively. That portion of clamping elements 71 between notches 72 and 73 is of such size as to be received in the central notch portion 68*a.*

The central portion 44 of the forward fence mounting bracket and the clamping element 71 are provided with coaxial holes 74 and 75 (see FIG. 2) to receive a thread cutting screw 76 so that the clamping element 71 may be drawn up into the mounting bracket notch 68 by screw 76.

Again referring to FIGS. 2, 11 and 12 the forward fence mounting bracket 44 is affixed to rack 1 in the following manner. Locating the front mounting bracket adjacent transverse rack wire member 13, the mounting bracket is longitudinally bowed (made possible by the bendable central section 46) to the extent that hook-like elements 61 and 64 can be engaged with longitudinal rack wire elements 4 and 9, respectively. When released, longitudinal wire elements 4 and 9 will seat within hook elements 61 and 64, and longitudinal wire elements 5, 6, 7 and 8 will seat within their respective notches 63, 66 and 68. At the same time, hook-like elements 62, 65 and 67 will engage transverse rack wire element 13. Clamping element 71 is then located in mounting bracket notch 68 and tightened in place by screw 76 to lock the front mounting bracket in place. Since the front mounting bracket 44 engages not only the longitudinal rack wire elements 4 through 9, but also transverse rack wire element 13, a shifting of the forward fence mounting bracket 44 with respect to rack 1 is rendered impossible.

Figure 13:
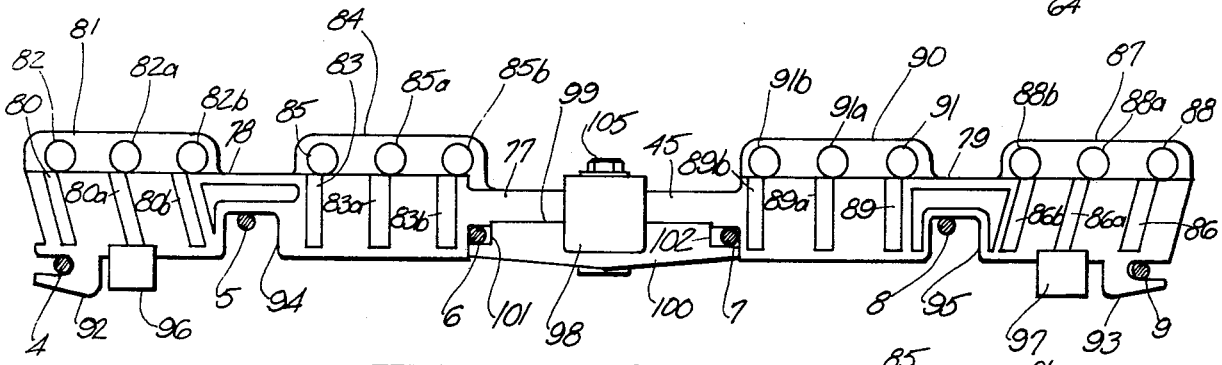
FIG. 13 is an elevational view of the slotted side of the rear fence mounting means of the present invention.
Figure 14:
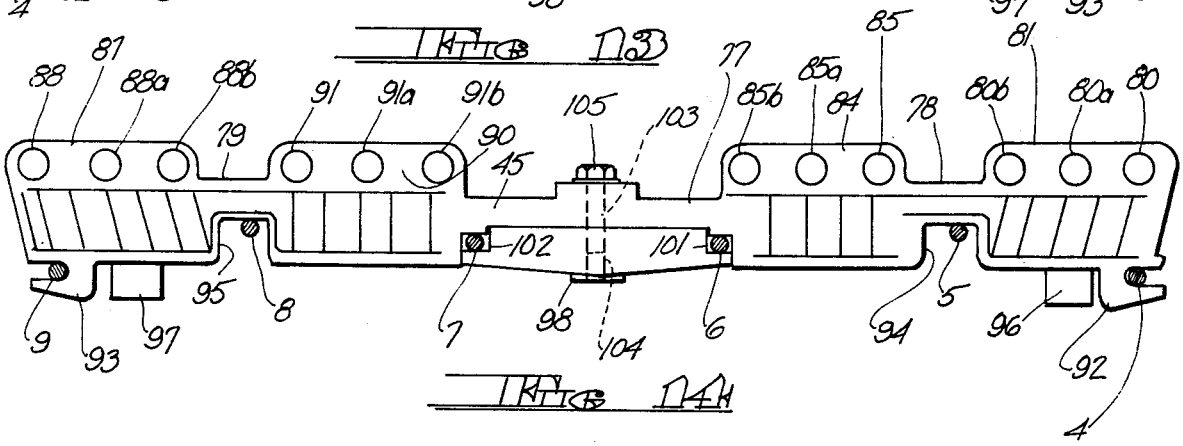
FIG. 14 is an elevational view of the opposite side of the rear fence mounting means from that shown in FIG. 13.

FIGS. 2, 13 and 14 illustrate the rearward fence mounting bracket 45. FIG. 13 illustrates that side of the rearward mounting bracket which faces forward mounting bracket 44, while FIG. 14 illustrates the opposite side of the rearward mounting bracket. Like parts have been given like index numerals.

Rearward mounting bracket 45 has a central bendable portion 77 and end portions 78 and 79. End portion 78 is in many respects similar to end portion 47 of the forward mounting bracket and is provided with a first series of upwardly and outwardly sloping slots 80 through 80*b* adapted to cooperate with slots 49 through 49*b* of the forward mounting bracket to mount fence 25 in any one of three predetermined positions. The upper edge of the rearward mounting bracket has an upstanding member 81 with a plurality of perforations 82 through 82*b* therethrough. Slots 80 through 80*b* are intended to receive the endmost vertical element 26 of fence 25. Each one of perforations 82 through 82*b* cooperates with the adjacent one of the slots 80 through 80*b* to receive the end of horizontal element 42 of fence 25 when the vertical fence element 26 is located in the adjacent slot. This effectively prevents the vertical fence element 26 from being inadvertently dislodged from the desired one of slots 80 through 80*b.*

End portion 78 of the rearward fence mounting bracket 45 is provided with a second group of slots 83 through 83*b* corresponding to slots 52 through 52*b* of the forward mounting bracket and intended to receive the end most vertical element 26*a* of fence 25*a.* It will be noted that slots 83 through 83*b* are vertically oriented. The end portion 78 is provided with a second upstanding member 84 substantially identical to upstanding member 81 and provided with perforations 85 through 85*b*, each intended to cooperate with the adjacent one of slots 83 through **83*b* in the manner described with respect to perforations 82 through 82*b***.

End element 79 has a series of upwardly and outwardly extending slots 86 through **86*b* intended to cooperate with slots 55 through 55*b* of forward mounting bracket 44 to provide three predetermined positions for fence 25*c* (see FIG. 2). An upstanding member 87 contains perforations 88 through 88*b* for cooperation with slots 86 through 86*b*, respectively. Finally, another set of vertically oriented slots is illustrated at 89 through 89*b* with an adjacent upstanding member 90 containing perforations 91 through 91*b* for cooperation with slots 89 through 89*b*. The slots 89 through 89*b* correspond to slots 58 through 58*b* of the forward mounting bracket 44 to retain fence 25*b*** in any one of three predetermined positions.

The manner in which the rearward fence mounting bracket 45 is affixed to rack 1 is substantially identical to that described with respect to the forward fence mounting bracket 44. To this end, the rearward mounting bracket 45 has hook-like elements 92 and 93 adapted to engage longitudinal rack wires 4 and 9, respectively. Notches 94 and 95 are provided to accommodate longitudinal rack wires 5 and 8. Downwardly depending forwardly extending hook-like elements 96 and 97 are intended to engage transverse rack wire 20.

Finally, the bendable central portion 77 of the rearward fence mounting bracket 45 is provided with a forwardly and downwardly extending hook-like element 98, similar to the hook-like element 67 of the forward mounting bracket and intended to engage transverse rack wire 20. The central portion 45 is also provided with a notch 99 substantially identical to notch 68 of the forward mounting bracket and intended to receive the longitudinal rack wires 6 and 7. A clamping element 100 is provided. Clamping element 100 is identical to clamping element 71 and has notches 101 and 102 to receive longitudinal rack wires 6 and 7, respectively. As will be noted from FIG. 14, the central portion 77 of rearward mounting bracket 45 and the clamping element 100 have coaxial holes 103 and 104, respectively, to receive a thread cutting screw 105. It will be understood that the rearward fence mounting bracket 45 is affixed to the rack 1 at the position shown in FIG. 2 and in a manner identical to that described with respect to the forward fence mounting bracket 44.

It will be evident to one skilled in the art that the forward and rearward fence mounting brackets 44 and 45 lend themselves well to be molded of any appropriate synthetic or plastic material capable of withstanding the conditions of temperature, humidity, etc., which normally obtain in the vat of a dishwasher. It will also be noted that end portion 47 of the forward fence mounting bracket 44 is not a mirror image of end portion 48. Similarly, end portion 78 of the rearward fence mounting bracket 45 is not a mirror image of end portion 79. This is true because all of fences 25 through **25*c*** are identical. The ends of the forward and rearward fence mounting brackets could be mirror images of each other, but this would require a pair of right hand fences and a pair of left hand fences.

Insertion of the fences in the forward and rearward mounting brackets 44 and 45 may be accomplished in the following manner. Turning to FIG. 2, it will be assumed that it is desired to locate fence 25 as near the lefthand rack side **1*c* as possible. To achieve this, the endmost upright wire member 26 of fence 25 is located in slot 80 of the rearward fence mounting bracket 45 and simultaneously the adjacent end of the horizontal fence member 42 is inserted through the adjacent perforation 82 of member 81 on the rearward bracket. Next, the endmost upright wire member 41 of fence 25 is located in slot 49 of the forward fence mounting bracket 44 and is latched in place by means of latch element 43. The mounting of any of fences 25 through 25*c*** in any of their respective notch combinations is accomplished in precisely the same manner.

Figure 6:
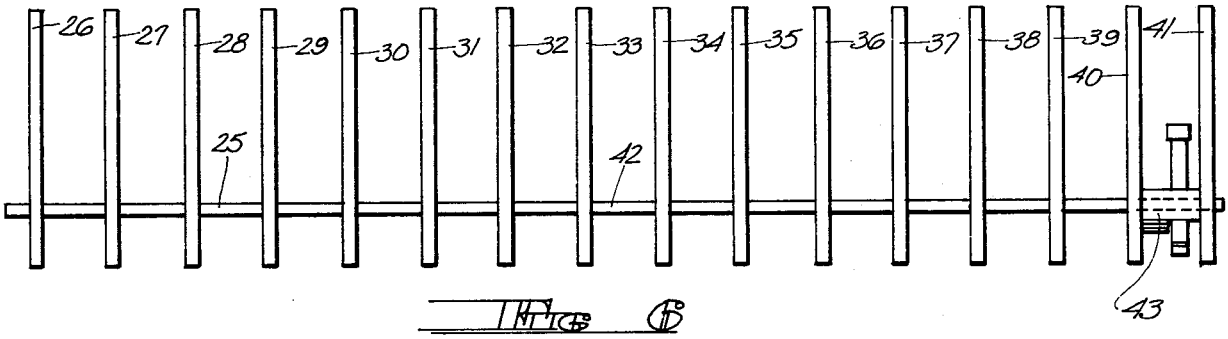
FIG. 6 is a side elevational view of the fence of FIG. 5.
Figure 7:
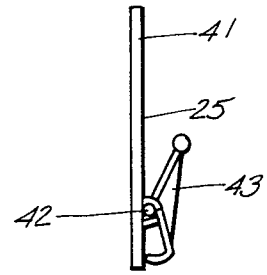
FIG. 7 is an end elevational view of the fence of FIGS. 5 and 6.
Figure 8:
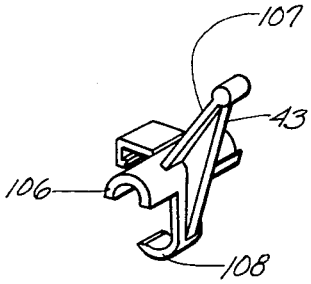
FIGS. 8 and 9 are perspective views of the latch means of the present invention.
Figure 9:
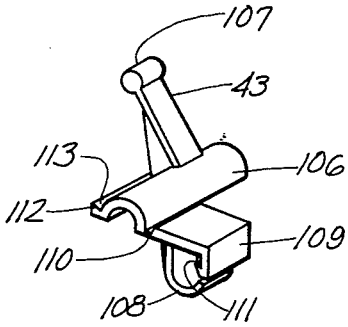
Figure 10:
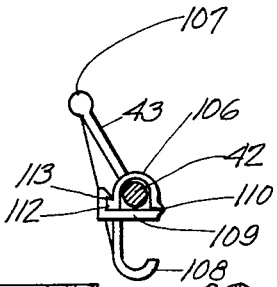
FIG. 10 is an end elevation of the latch means.

FIGS. 6 and 7 illustrate fence latch 43 mounted on the horizontal fence member 42. The fence latch itself is shown in FIGS. 8 through 10. Fence latch 43 comprises a semi-cylindrical body portion 106, the internal diameter of which is slightly larger than the diameter of horizontal fence wire member 42. The body 106 has an integral one piece handle element 107 extending upwardly therefrom and an integral one piece latch hook 108 depending downwardly therefrom.

Turning to FIGS. 8 and 9, the body 106 has a laterally extending attachment hook 109 connected to the body 106 by a thin integral web 110 intended to serve as a hinge element. The attachment hook terminates in an undercut latching surface 111. On the opposite side of body 106 and diametrically opposed to attachment hook 109 there is an attachment lug 112 with a downwardly and inwardly sloping latching surface 113.

Turning to FIG. 10, it will be understood that to affix latch element 43 to the horizontal member 42 of fence 25 it is only necessary to place the latch body 106 over horizontal member 42 and then to swing the attachment hook in a clockwise direction (as viewed in FIG. 10) until hook latching surface 111 engages lug latching surface 113. In this manner latch element 43 is pivotally affixed to the fence horizontal member 42. Latch element 43 lends itself well to be molded of an appropriate plastic material.

Turning to FIG. 2, it will be noted that all of fences 25 through **25*c* are provided with identical latch elements 43. Turning next to FIG. 11 it will be noted that the endmost upright fence element 41*c* of fence 25*c* is illustrated as located in slot 55 of the forward fence mounting bracket. It will be understood that the endmost upright element 26*c* of fence 25*c* will be located in corresponding slot 86 of the rearward fence mounting bracket 45 (see FIG. 2). Once fence 25*c* is located in the desired slot combination, latch element 43 is rotated about the horizontal fence element 42*c* in a counter clockwise direction (as viewed in FIG. 11) until the latch hook 108 engages latch lug 57. At this point, fence 25*c*** is firmly locked in place.

All of the components of the rack structure of the present invention have now been described. While not so limited, excellent results have been achieved when all of the wire members of rack 1, and fences 25 through 25c have been formed of No. 8 to No. 11 gauge carbon steel wire. It will be understood by one skilled in the art that the entire rack structure, including the removable fences, may be coated (by dipping or otherwise) with a plastic material, as is common in the art, to prevent rust and corrosion.

FIG. 3 illustrates an exemplary mode of loading tableware in the rack 1 of the present invention. It will be understood that all of the upstanding elements of all of the fences 25 through **25*c* lie opposite each other transversely of the rack so as to properly support the tableware (see FIG. 2). As shown in FIG. 3 a series of dishes exemplified by dish 114** may be supported by removable fences 25*a* and 25*b*. It will be noted that the lowermost edge of the dish 114 rests upon the horizontal members 42*a* and 42*b* of these fences. Thus, the dish 114 is maintained upwardly of the rack bottom and does not extend below the rack bottom to interfere with tableware on the lower rack or an intermediate spray device located between the upper and lower racks. Similarly, a series of dishes may be loaded as illustrated by dish 115. Dish 115 is shown engaged by removable fences 25*b* and 25*c* with its bottom edge resting upon the horizontal members 42*b* and 42*c* of these fences. Dishes can, of course, be similarly supported on the horizontal members 42 and 42*a* of fences 25 and 25*a*. In fact, depending upon the size and shape of the tableware to be supported, any combination of two or more fences located in any of the cooperating pairs of slots in the forward mounting bracket 44 and rearward mounting bracket 45 may be used.

When large pieces of tableware or oddly configured pieces are to be washed, some or all of the removable fences 25 through 25*c* may be dislodged from forward mounting bracket 44 and rearward mounting bracket 45 and withdrawn from the rack. This, of course, would leave a large portion or all of the rack 1 open for such tableware. The tableware in such an instance would rest upon the bottom of rack 1.

Finally, FIG. 3 illustrates the manner in which drinking glasses may be supported within rack 1. An exemplary drinking glass is shown at 116. The drinking glass 116 is inverted so that its upper end rests upon the rack bottom. The transverse wire elements 12 through 20 of the rack bottom are so configured as to cause the drinking glass to lean against upwardly and outwardly sloping fence 25 in the manner shown. This will insure that both the interior of the glass and the exterior bottom of the glass will drain properly. Similarly, a drinking glass exemplified by glass 117 may be so located so as to rest upon the rack bottom and lean against the upwardly and outwardly sloping side 1*c* of rack 1. This accomplishes the same draining advantages. Of course, fence 25*c* and the righthand rack wall 1*d* could be utilized in the same manner. Cups and mugs may be placed in the rack in the same manner described with respect to drinking glasses 116 and 117 with the same advantageous draining results.

Modifications may be made in the invention without departing from the spirit of it. For example, turning to FIGS. 1 and 2 it will be noted that the removable fences 25 through 25*c* are of such length and the forward mounting bracket 44 and rearward mounting bracket 45 are so located that the fences do not extend to the front wall 1*a* of the rack. By proper relocation of forward mounting bracket 44 and rearward mounting bracket 45, or by proper relocation of forward mounting bracket 44 and the provision of longer fences, the fences may be caused to extend substantially the full length of rack 1. In the embodiment shown a transverse space has been left at the forward end of rack 1 for long tableware or for the receipt of the utility basket of any known type. An exemplary utility basket for use with the rack of the present invention is taught in the copending application in the name of William H. Yake and Donald G. Wallace, Ser. No. 468,001, filed May 8, 1974 and entitled UTILITY BASKET FOR A DISHWASHER.

Figure 12:
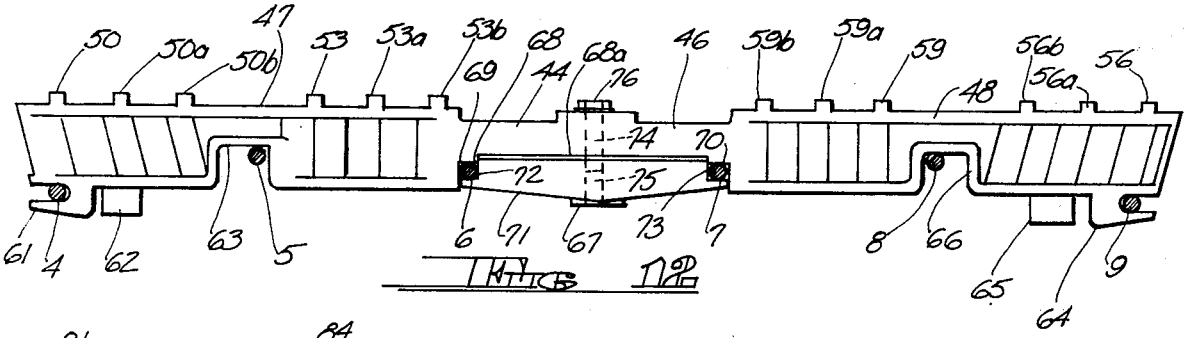
FIG. 12 is an elevational view of the opposite side of the front fence mounting means from that shown in FIG. 11.

It is also within the scope of the present invention to substitute for the forward mounting bracket 44 of FIGS. 11 and 12 a mounting bracket comprising a mirror image of mounting bracket 45 of FIGS. 13 and 14. Under these circumstances, latches 43 would not be required on fences 25 through 25*c*. The fences would be located in cooperating slots and holes of such mounting brackets by bowing the fences to the extent that their effective length would permit insertion of both ends of the fence horizontal elements into their respective mounting bracket holes. Again, all of the fences could be identical.

Finally, while it has been stated above that the preferred embodiment of the rack of the present invention utilizes four fences, the actual number of removable fences does not constitute a limitation on the present invention. Similarly, the placement of the fence receiving notches and the number thereof in the forward mounting bracket 44 and rearward mounting bracket 45 are not intended to constitute limitations. It will further be understood that by appropriate design of the mounting brackets and by appropriate location and configuration of the transverse and longitudinal wire elements making up the bottom of rack 1, the fences could be caused to extend transversely of the rack, rather than longitudinally thereof.

The embodiments of the invention in which an exclusive property or privilege is claimed are defined as follows:

1. A rack structure for an automatic dishwasher comprising a plurality of wire members welded together to form a rectangular openwork rack having a bottom and upstanding front, rear and longitudinal side walls, at least one removable fence, means to detachably mount said removable fence within said rack in parallel spaced relationship to said longitudinal side walls of said rack, said fence mounting means comprising a forward fence mounting bracket and a rearward fence mounting bracket, said forward and rearward fence mounting brackets being affixed to said rack bottom in parallel spaced relationship to each other and to said front and rear walls of said rack, said forward and rearward fence mounting brackets having opposed faces in parallel spaced relationship, said opposed faces having at least one pair of corresponding slots for said at least one removable fence, said at least one removable fence having end portions receivable in said at least one pair of corresponding slots in said forward and rearward fence mounting brackets.

2. The structure claimed in claim 1 wherein said fence mounting means are so configured as to maintain said at least one removable fence in any one of a plurality of predetermined positions within said rack.

3. The structure claimed in claim 1 wherein said at least one removable fence comprises an elongated horizontal wire element and a plurality of upstanding wire members in parallel spaced relationship and affixed near their bottom ends to said horizontal wire element.

4. The structure claimed in claim 1 including more than one removable fence, said fence mounting means being so configured as to maintain each of said removable fences in any one of a plurality of predetermined positions within said rack, said fences being in parallel spaced relationship to each other.

5. The structure claimed in claim 1 wherein said rack structure and said at least one fence are coated with a protective plastic material.

6. The structure claimed in claim 1 wherein said forward and rearward fence mounting brackets are molded of plastic material.

7. The structure claimed in claim 1 including a plurality of pairs of corresponding slots for said at least one fence in said opposed faces of said forward and rearward mounting brackets whereby to afford a plurality of predetermined location selections within said rack for said at least one fence.

8. The structure claimed in claim 1 including means to lock said at least one removable fence in said slots.

9. The structure claimed in claim 8 wherein said at least one removable fence comprises an elongated resilient horizontal wire element having a forward end and a rearward end and a plurality of upstanding wire members in parallel spaced relationship and affixed near their bottom ends to said horizontal wire element, those upstanding wire members nearest said forward and rearward ends of said horizontal wire element being receivable in said at least one pair of corresponding slots, said forward and rearward fence mounting brackets each having an upstanding member adjacent said slot therein, said upstanding members each having a perforation to receive respectively said forward and rearward ends of said fence horizontal wire element, whereby said last mentioned fence upstanding wire elements may be inserted in said at least one pair of corresponding slots in said forward and rearward mounting brackets and said forward and rearward ends of said fence horizontal wire element may be inserted in their respective perforations upon slight longitudinal bowing of said horizontal wire element during mounting of said at least one fence.

10. The structure claimed in claim 8 wherein said at least one removable fence comprises an elongated horizontal wire element having a forward end and a rearward end and a plurality of upstanding wire members in parallel spaced relationship and affixed near their bottom ends to said horizontal wire element, those upstanding wire members nearest said forward and rearward ends of said horizontal wire element being receivable in said at least one pair of corresponding slots, said rearward fence mounting bracket having an upstanding member adjacent said slot therein, said upstanding member having a perforation to receive the rearward end of said fence horizontal wire element, a latching hook being pivotally mounted on said fence horizontal wire element near its forward end, said forward fence mounting bracket having a latching lug extending toward said rearward mounting bracket and engageable by said latching hook when said last mentioned upstanding wire members are seated in said pair of corresponding slots.

11. The structure claimed in claim 10 wherein said latching hook has a body portion made up of two parts hinged together and capable of being closed and locked about said horizontal wire element and being pivotal thereon, one of said body parts having said latching hook depending therefrom and a handle element extending upwardly therefrom.

12. A rack structure for an automatic dishwasher comprising a plurality of wire members welded together to form a rectangular openwork rack having a bottom and upstanding front, rear and longitudinal side walls, at least two removable fences, means to detachably mount said removable fences within said rack, said fence mounting means being so configured as to maintain each of said removable fences in any one of a plurality of predetermined positions within said rack, said fences being in parallel spaced relationship to each other and to said longitudinal side walls of said rack, said fence mounting means comprising a forward fence mounting bracket and a rearward fence mounting bracket, said forward and rearward fence mounting brackets being affixed to said rack bottom in parallel spaced relationship to each other and to said front and rear walls of said rack, said forward and rearward fence mounting brackets having opposed faces in parallel spaced relationship, said opposed faces having at least one pair of corresponding slots for each of said removable fences, each of said removable fences having end portions receivable in its respective one of said pairs of corresponding slots in said forward and rearward fence mounting brackets.

13. The structure claimed in claim 12 including four removable fences, said at least one pair of corresponding slots for each of said two fences adjacent said longitudinal rack side walls being so oriented as to cause each of said two fences to slope upwardly and toward its respective one of said side walls, said at least one pair of corresponding slots for the remaining two of said fences being so oriented as to cause said last mentioned two fences to be vertically oriented within said rack.

14. The structure claimed in claim 12 including means to lock said removable fences in said pairs of corresponding slots.

15. The structure claimed in claim 14 wherein each of said removable fences comprises an elongated resilient horizontal wire element having a forward end and a rearward end and a plurality of upstanding wire members in parallel spaced relationship and affixed near their bottom ends to said horizontal wire element, those upstanding wire members nearest said forward and rearward ends of said horizontal wire element of one of said fences being receivable in said at least one pair of corresponding slots for that fence, said forward and rearward fence mounting brackets each having an upstanding member adjacent each of said slots therein said upstanding members each having a perforation therethrough for each adjacent slot to receive respectively said forward and rearward ends of said horizontal wire element of one of said fences, whereby said last mentioned upstanding wire elements may be inserted in said at least one pair of corresponding slots in said forward and rearward mounting brackets and said forward and rearward ends of said fence horizontal wire element may be inserted in their respective perforations upon slight longitudinal bowing of said horizontal wire element during mounting of said at least one fence.

16. The structure claimed in claim 14 wherein each of said removable fences comprises an elongated horizontal wire element having a forward end and a rearward end and a plurality of upstanding wire members in parallel spaced relationship and affixed near their bottom ends to said horizontal wire element, those upstanding wire members nearest said forward and rearward ends of said horizontal wire elements of one of said fences being receivable in said at least one pair of corresponding slots for that fence, said rearward fence mounting bracket having an upstanding member adjacent each of said slots therein, said upstanding members having a perforation therethrough for each adjacent slot to receive the rearward end of said horizontal wire element of one of said fences, a latching hook being pivotally mounted on said horizontal element of each of said fences near its forward end, said forward fence mounting bracket having a latching lug adjacent each slot therein and extending toward said rearward mounting bracket, each of said latching lugs being engageable by said latching hook when a fence is seated in an adjacent slot in said forward mounting bracket and a corresponding slot in said rearward mounting bracket.

17. The structure claimed in claim 16 wherein said latching hook has a body portion made up of two parts hinged together and capable of being closed and locked about said horizontal wire element and being pivotal thereon, one of said body parts having said latching hook depending therefrom and a handle element extending upwardly therefrom.

* * * * *